US010697170B1

(12) United States Patent
Mazzola Vernengo

(10) Patent No.: US 10,697,170 B1
(45) Date of Patent: Jun. 30, 2020

(54) SET OF EXTRUDED SHAPES FOR GLASS BALCONY RAILINGS AND ENCLOSURES

(71) Applicant: Pablo Remo Mazzola Vernengo, La Calera (AR)

(72) Inventor: Pablo Remo Mazzola Vernengo, La Calera (AR)

( * ) Notice: Subject to any disclaimer, the term of this patent is extended or adjusted under 35 U.S.C. 154(b) by 0 days.

(21) Appl. No.: 16/524,919

(22) Filed: Jul. 29, 2019

(51) Int. Cl.
*E04B 1/00* (2006.01)
*E04F 11/18* (2006.01)

(52) U.S. Cl.
CPC ..... *E04B 1/003* (2013.01); *E04F 11/1804* (2013.01); *E04F 11/1853* (2013.01); *E04F 2011/1868* (2013.01)

(58) Field of Classification Search
CPC ... E04B 1/003; E04F 11/1804; E04F 11/1853; E04F 2011/1868; E04F 11/1817; E04F 11/1812; E04F 2011/1823; E04H 17/22; E04H 17/14; E04H 17/1413
USPC ..... 52/295, 296, 125.4, 126.3; 256/24
See application file for complete search history.

(56) References Cited

U.S. PATENT DOCUMENTS

| | | | | | |
|---|---|---|---|---|---|
| 4,067,548 | A * | 1/1978 | Murphy | E04F 11/1851 | 256/24 |
| 4,920,717 | A * | 5/1990 | Hooper, Jr. | E04F 11/1812 | 52/204.597 |
| 9,777,484 | B2 * | 10/2017 | Header | E04F 11/1853 | |
| 9,816,276 | B2 * | 11/2017 | Noble | E04F 11/1834 | |
| 9,920,522 | B2 * | 3/2018 | Staten | E04B 2/7455 | |
| 10,030,393 | B2 * | 7/2018 | Spence | E04F 11/1812 | |
| 2010/0307082 | A1 * | 12/2010 | Nash | E04F 11/1851 | 52/238.1 |

(Continued)

*Primary Examiner* — Brian E Glessner
*Assistant Examiner* — Adam G Barlow
(74) *Attorney, Agent, or Firm* — Bond, Schoeneck & King, PLLC; Blaine Bettinger; George McGuire

(57) ABSTRACT

Set of shapes for retaining a glass plate, including a first shape (10) having a base plate (11) from which project columns (12*a*, 12*b*) between which define a longitudinal channel (13), having at the upper end of each column a longitudinal groove (14, 15).

Second shapes (20) arranged vertically aligned on each column of the first shape, this second shape having at its lower end an appendix (22) complementary to the groove (14, 15); presenting the upper end of the second shape on its edge of its internal face a longitudinal recess (27') that determines the means of seating and securing a third shape (30).

Said third shape each has an upper surface (32, 32') that sits on the upper end (27) of the second shape, with a longitudinal fold complementary to the longitudinal recess (27') of the second shape and within which it sits in retention. The upper surface (32, 32') projects downwards attached to the external surface (12, 24) of (10, 20) covering the joint between them.

The lower end of each third shape forms at the lower end a longitudinal "L" seat (38) turned towards the external face of each column of the first shape.

A fourth shape (40) is placed on each side of the corresponding column of the first shape and has a substantially horizontal wing (42) at the free end of which has a longitudinal projection (43) that seats in connection with the longitudinal recess seat (27').) of the third shape: said horizontal wing (42) is continued by a section of shape (45) partially attached against the external face of the respective column up to where a continuous concave surface (47) projects facing a hosted light source in (39*h*).

6 Claims, 9 Drawing Sheets

(56) References Cited

U.S. PATENT DOCUMENTS

| | | | | |
|---|---|---|---|---|
| 2012/0189378 | A1* | 7/2012 | Visa | E04F 11/1853 403/267 |
| 2014/0326419 | A1* | 11/2014 | Ona-Gonzalez | E05D 15/0604 160/115 |
| 2018/0112434 | A1* | 4/2018 | Sprague | F16J 15/025 |
| 2019/0218786 | A1* | 7/2019 | Bieler | E04F 11/1812 |

* cited by examiner

SET OF EXTRUDED SHAPES FOR GLASS BALCONY RAILINGS AND ENCLOSURES

FIELD OF INVENTION

The invention relates to the enclosure and balcony railing construction formed by transparent or translucent plates, such as tempered or laminated glass, capable of offering a decorative view without obstructions achieving a height at the crowning of the enclosure between 80 to 300 cms.

BACKGROUND TO THE INVENTION

Using laminated and/or tempered glass panels for balconies, terraces, swimming pools, solariums enclosures and room dividers is a well-known resource employed by professionals in the construction and decoration arts.

Said enclosures advantageously prevents or mitigate the passage of wind while providing at the same a decorative environment, allowing a panoramic vision of the surroundings. For said aesthetics reasons, said enclosures formed by adjacent glass plates should employ as little as possible structural components such as uprights, which may mar said view and the decorative aspect of said enclosures.

The above said implies that if we do not place uprights, columns or other structural components, the anchoring of the glass panels is basically limited to fixing them to the floor, such as a balcony floor, slab, etc. inside a shape or shapes component into which lodges each glass plate: This limits the height of the crowning of the glass panels, resulting in very low height enclosures, preventing the construction of glass walls having a greater height, such as, for instance, up to 3 meters. Indeed, for security reasons, balcony railings must have a minimum height; while low height glass walls offers no means of protection against the action of the wind, hence their low height does not fulfil this purpose.

Additionally, considering the use of glass panels as spatial dividers (e.g.) separating grandstands from the actual playing field, the use of thick laminated glass panels is ideal because it allows the onlookers a view of the playing field without obstructions or limitations, while said glass panels for security reasons do not provide any possible means to climb over the separation barrier and perform an illegal entry into the playing field. Nevertheless, in these cases to constitute an effective barrier, said glass wall must have an average height of 3 meters. Its anchoring to the floor by means of known traditional means does not allow performing this construction unless structural reinforcing means are employed, such as columns or the like, obstructing the view.

for the purposes of this instant invention, the following terms have the following meanings:

ENCLOSURE: Is any structure or construction able to delimit or subdivide an area, enclosure, perimeter, balcony, railings or the like.

GLASS PANEL: It is any plate of transparent or translucent material, such as tempered glass, laminated glass, acrylic plates or the like.

TRANSPARENT: This term must be understood as the ability of the panel to be transparent and allow, with a greater or lesser degree depending on its tonality, the vision through it. It is included within this term the translucent panels such as one way mirrors, or partially decorated glass panels.

OBJECTS OF THE INVENTION

The main object of the present invention is a set of extruded shapes allowing fitting glass panels with a height up to 3 meters for the construction of transparent railings, dividing walls, etc., without the need to use of columns or intermediate uprights or reinforcing posts, providing an effective protection or a shield from the action of the wind while achieving an unrestricted view through said panels.

It is object of the present invention to install sources of light adjacent to the base of the fastening set of shapes for said glass panels, preferably LED lights, which apart from providing a soft indirect lighting allow to increase the aesthetic and decorative effect of said panels.

It is an object of the invention that said panels are immobilized inside said set of shapes with absolute security; the base of the shapes is anchored to the floor or surface, being a section of said shapes aligned with the next abutting one by means of horizontally aligned components joining both abutted shapes.

It is a further object having the mechanical strength of the glass panel exclusively limited to the thickness of the glass sheet, each sheet basically working cantilever with respect to the anchored set of shapes.

SUMMARY OF THE INVENTION

SET OF EXTRUDED SHAPES FOR GLASS BALCONY RAILINGS AND ENCLOSURES, each one of said shapes having a longitudinal axis with equal transversal successive sections thereof perpendicular to said axis, characterized in that it includes in combination:

a) a first shape suitable to be anchored to a surface, having this first shape a base plate resting on said surface, monolithically projecting from said base plate two columns separated the one from the other defining in between its internal faces a longitudinal channel or space opened upwards, having at the upper end of each of said columns a longitudinal groove, determining a wing on each side of each groove;

b) second shapes substantially placed vertically aligned on top of each of said columns of the first shape; projecting from the lower end of each of said second shapes an appendix lodged in retention in the corresponding longitudinal groove of each column of the first shape, being the mutually facing surfaces of said second shapes separated from each other in continuation of the longitudinal channel of the first shape; the upper end of each second shape has a longitudinal recess on its edge with the respective internal face thereof determining a seat and fastening means for a respective third shape: the outer face of each second shape is aligned in continuity to the outer surface of each column of the first shape;

c) third shapes, each having at least one upper surface which rests on the upper end of the corresponding second shape, the internal edge of said upper surface of each third shape having a longitudinal fold complementary to the longitudinal recess of the second shape within which sits on retention; from the upper surface of each third shape a wall extends monolithically downwards adjacent to the external surface of both first and second shapes, covering the joint between them; the lower end of said wall of the third shape has a monolithically projected outward fold at the end of which bends downwards without reaching the upper face of the corresponding wing of the first shape, forming at the lower end a longitudinal "L" seat turned towards the external face of each column of the first shape;

d) a wall from a fourth shape is placed against each side of the corresponding column of the first shape, a substantially horizontal wing projects from the upper end of said wall with a free end thereof having a longitudinal projection that seats in connection with the longitudinal "L" seat of the third shape; the lower end of said wall of this fourth shape extends downwards until reaching a distance from the corresponding wing of the first shape, from which a longitudinal surface projects outwards, ending abutting the edge of the respective wing of the first shape; each of said fourth shapes having retaining means to the external face of each respective column of the first shape; the longitudinal channel between both columns of the first shapes and the internal faces of the second shapes determining a seat within which a glass plate lodges against polymeric wedges and counter-glass placed between said glass plate and the surface of the said longitudinal channel.

DETAILED DESCRIPTION OF THE PRESENT INVENTION

For the purposes of exemplifying a preferred embodiment of the present invention, the following drawings illustrating it are attached in support of the description thereof given below, this embodiment having to be interpreted as one of the many possible constructions of the invention, hence it is not appropriate to assign any limiting value to it, including within the scope of protection of the invention the possible equivalent means; the amplitude of the present invention being determined by its first claim.

Likewise, in these Figures, the same references identify equal or equivalent means equal and/or equivalent.

Figure 1:
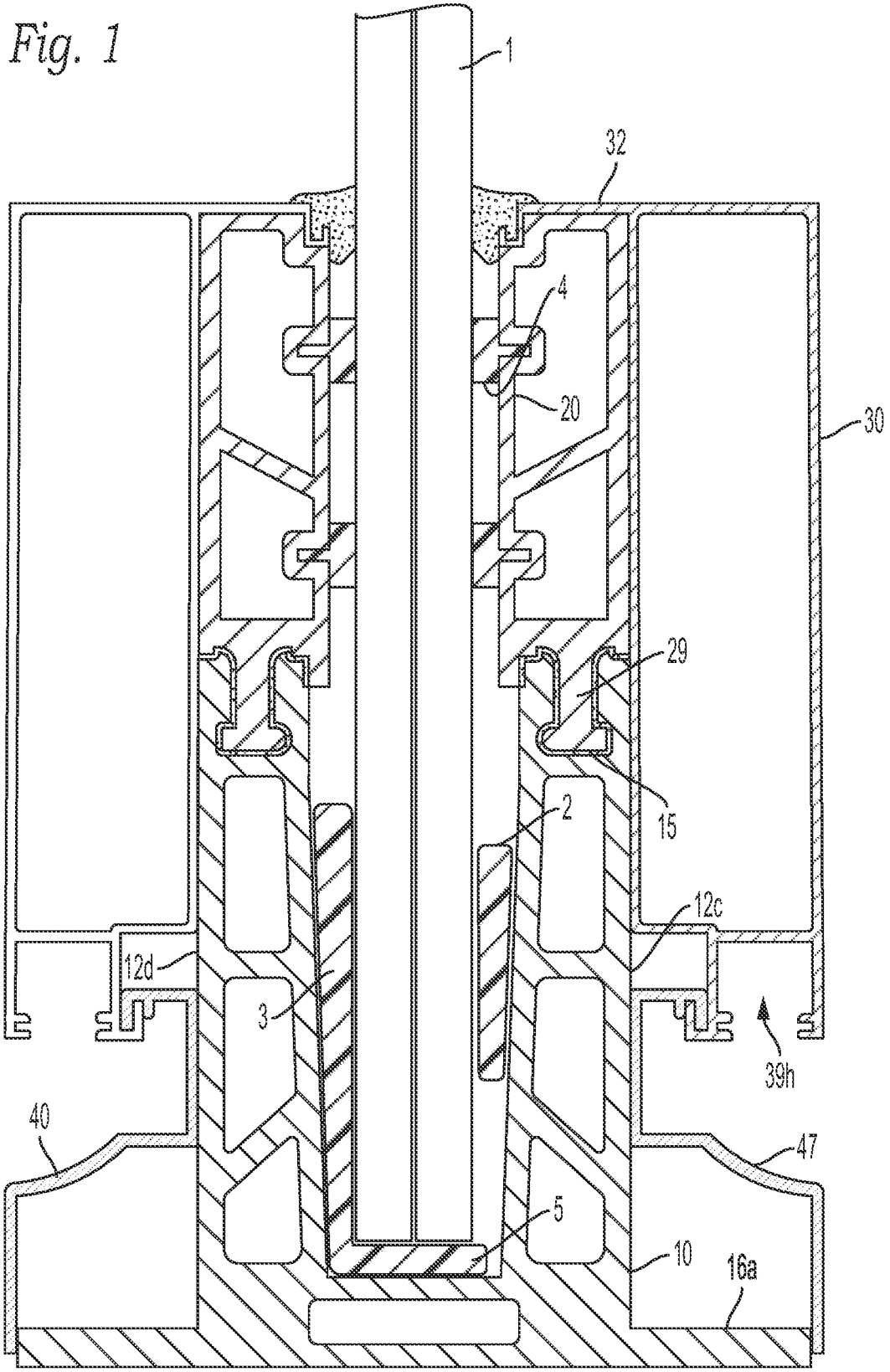
FIG. 1 shows a cross section of the assembled shapes with a glass plate inserted and retained within said assembly.

At FIG. 1 reference (10) generically indicates the first shape, while (20) being the second shape, (30) the third shape and (40) the fourth shape, all of them assembled within which one end of a glass plate (1) is inserted into the longitudinal channel or groove, said glass plate supporting and being retained by means of polymeric blocks (2, 3, 5) and counter-glasses (4).

Figure 2:
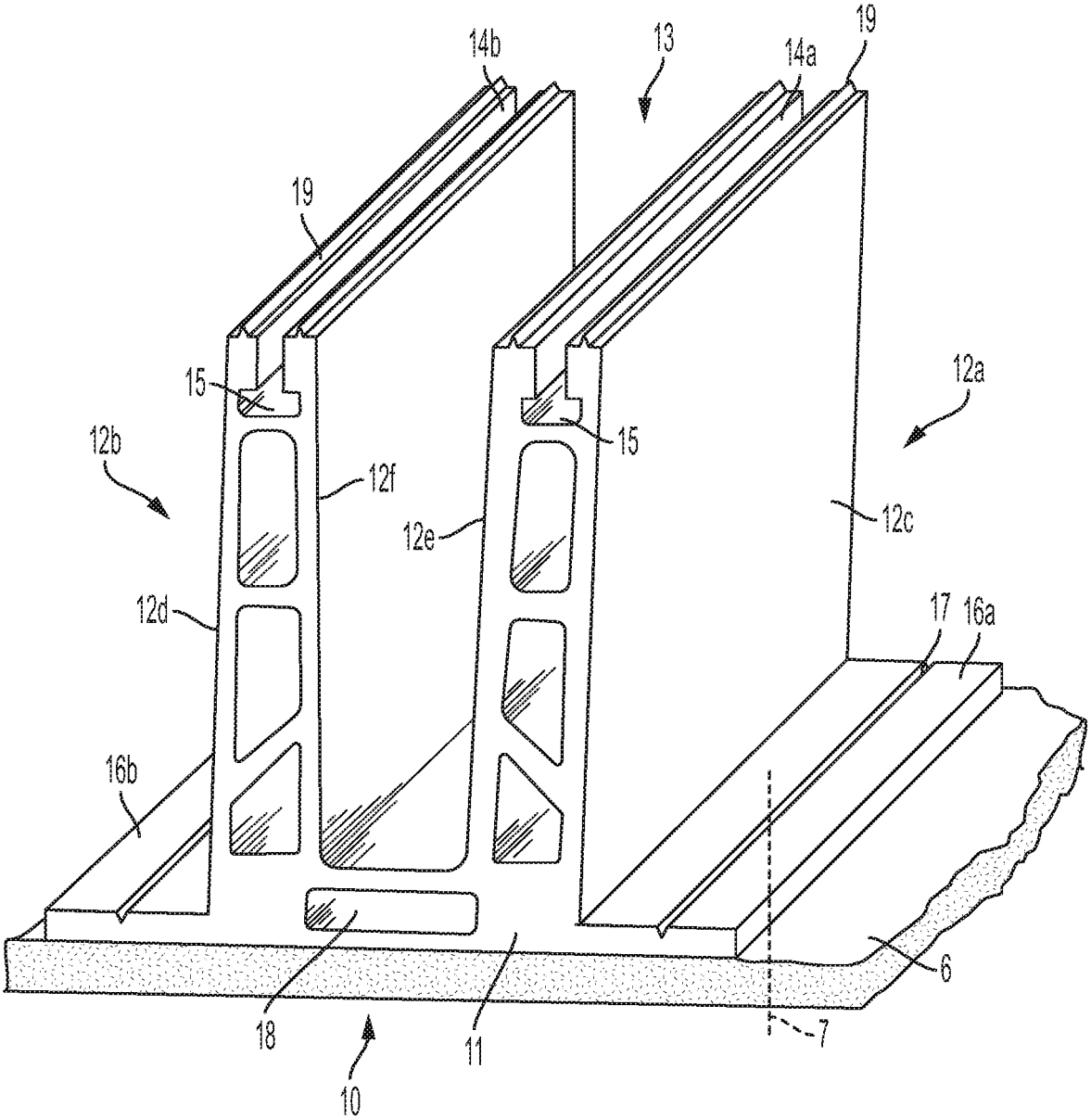
FIG. 2 shows a front/lateral perspective to the first shape.

FIG. 2 shows a perspective view of the first shape. A base plate (11) sits with its face or bottom surface on a surface (6) (See FIG. 2) such as a plate, slab, or the like, to which it is anchored by conventional means such as drills, screws, studs, and other means known in the art and represented generically by the broken line (7). From the upper face of said plate (11) two columns (12*a*, 12*b*) projects upwards monolithically, separated from each other forming a longitudinal channel or groove (13) between the two internal faces of each column, while the external surfaces, respectively (12*c*, 12*d*) of each column can be vertical with respect to the base plate (11); the faces or internal surfaces (12*e*, 12*f*) of the corresponding columns are slightly obliquely divergent upwards, defining a longitudinal groove or channel (13) whose entrance mouth widens slightly as it progresses in height.

The upper end of each column (12*a*, 12*b*) has a respective longitudinal groove (14*a*, 14*b*), and conveniently the bottom of each groove ends in an expansion (15) determines a longitudinal expansion. On each side of the columns (12*a*, 12*b*) plate (11) has respective coplanar wings (16*a*, 16*b*) determining the area in which the anchoring bores are performed, ideally along a line (17) marked on each wing, through which bores the above mentioned linking means (7) are through. Between both columns, the base plate (11) has a longitudinal passage (18) allowing the horizontal alignment of the abutting succession of first shapes (10).

Said longitudinal grooves (14*a*, 14*b*) are delimited by the respective upper portions of the external and internal walls of each column on which projects upwards therefrom corresponding longitudinal ribs (19).

Figure 3:
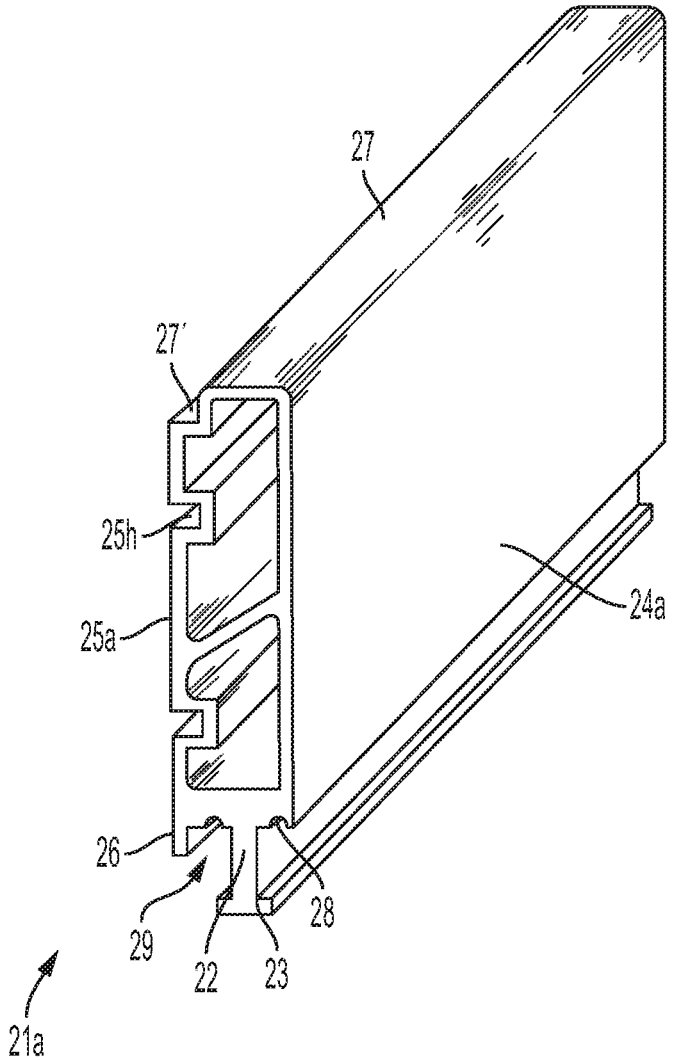
FIG. 3 illustrates a front/perspective of the second right side shape.
Figure 4:
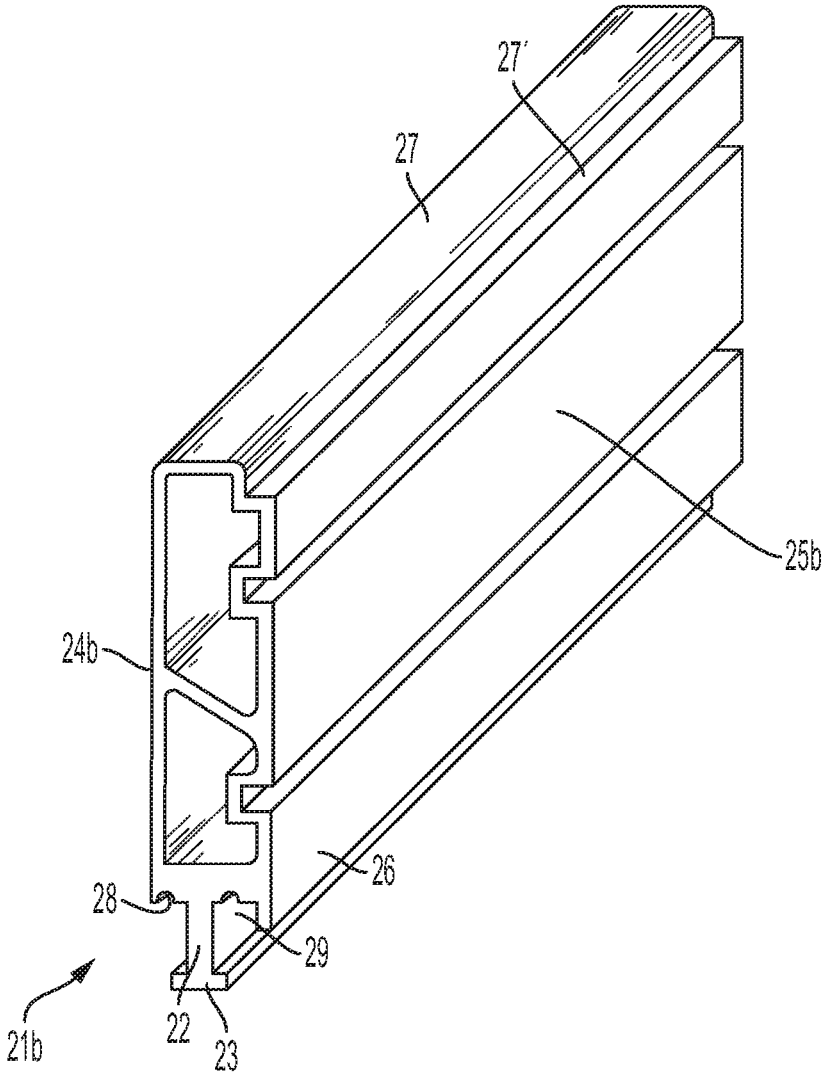
FIG. 4 illustrates a front/perspective of the second left side shape

FIG. 3 illustrates a front/lateral perspective of the second right hand side shape (21*a*) while FIG. 4 shows the same shape in its specular version, that is, the second left hand shape (21*b*). Both shapes are identical in their geometry and height, with the exception that the right shape is the specular sight of the left shape and vice versa. The second right hand shape (21*a*) is linked substantially vertically aligned to the column (12*a*), while the second left hand shape (21*b*) is substantially linked vertically to the column (12*b*) as illustrated in FIG. 1. Each of said second shapes (20) has at its lower end an appendix that lodges in retention in the respective longitudinal groove of each column of the first shape. Consequently the lower end of the right hand shape (21*a*) has a longitudinal appendage (22) projecting monolithically downward, ending in an expansion (23) complementary to the longitudinal expansion (15) of the first shape, thus achieving by this means the assembly of the corresponding second shape (20) to the corresponding column of the first shape (10).

The right hand side shape (21*a*) has its right side corresponding to its outer face (24*a*) preferably smooth and vertically aligned coplanar with the external face of the column (12*a*) of the first shape, while the left shape (21*b*)) has its left face corresponding to its outer face (24*b*) preferably smooth and vertically aligned coplanar with the external face of the column (12*b*) of the first shape. (See FIG. 1). The verticality between both shapes (10, 20) already assembled is ensured by presenting the respective internal faces (25*a*, 25*b*) of the respective second shape (20) at its lower end with a short longitudinal and monolithic extension (26), which defines a small wall supporting against the corresponding internal face (12*e*, 12*f*) of the columns of the first shape (10) defining between (26, 22) a longitudinal recess (29) complementary to the longitudinal crowning of the respective upper end of the inner wall of each column, which is assisted by the presence of longitudinal grooves (28) complementary to the ribs (19) immobilizing the shape (20) in the column as the complementary expansion (23) sliding upon its assembly through the slit (15) and the end is housed within the longitudinal housing (29).

The upper end of each second shape (20) has a longitudinal surface (27) adjacent of the respective internal face (25*a*, 25*b*) which has a longitudinal recess (27'), and each internal face (25*a*, 25*b*) presents a series of longitudinal recesses (25*h*) inside which seats the counter-glass chocks (4) illustrated in FIG. 1.

Figure 5:
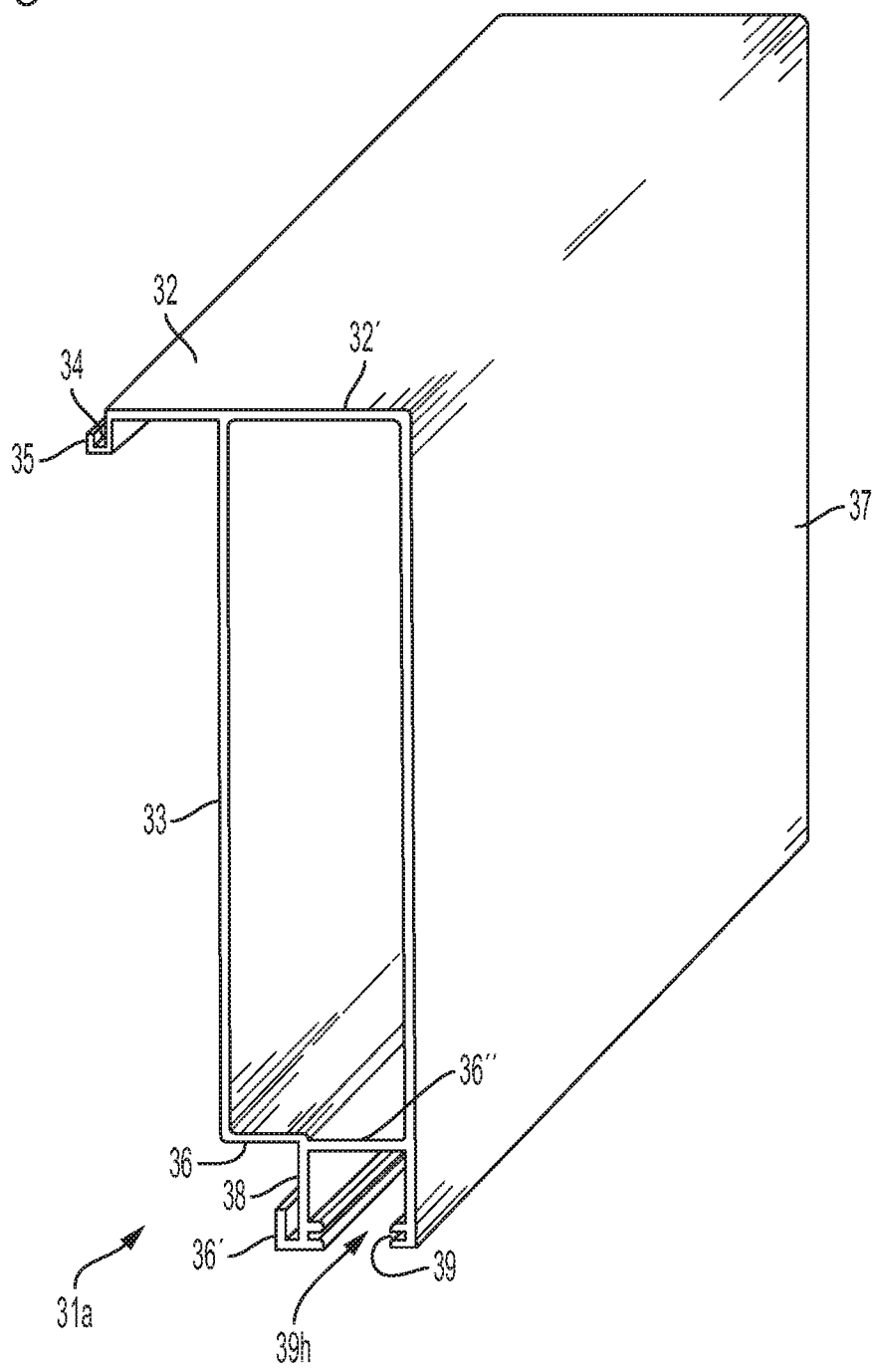
FIG. 5 illustrates a front/perspective of the third right side shape.
Figure 6:
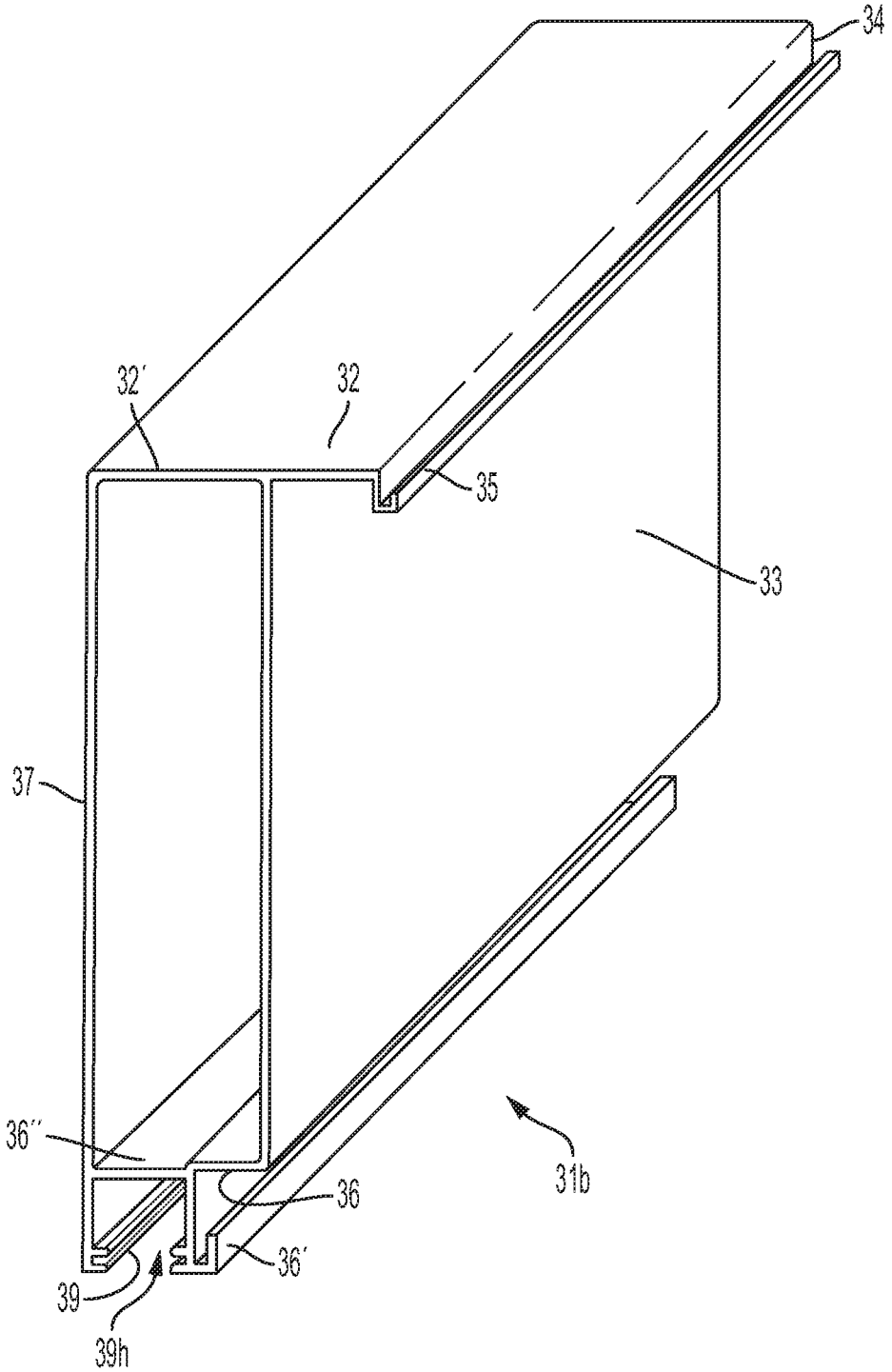
FIG. 6 illustrates a front/perspective of the third left side shape.

FIG. 5 illustrates a front/lateral perspective of the second right hand side shape (31*a*) while FIG. 6 shows the same shape in its specular version, that is, the second left hand shape (31*b*). Both shapes are identical in their geometry and height, with the exception that the right shape is the specular sight of the left shape and vice versa.

Each of said third shapes (31*a*, 31*b*) has at least one longitudinal upper surface (32) which seats with its inner face attached to the upper surface (27) of the respective second shape (20). Preferably the upper surface (27) is flat and horizontal, so that surface (32) on its inner face is also flat and horizontal, but nothing prevents designing shapes with corresponding oblique, domed, convex surfaces (27, 32) with the condition that (32) is complementary to (27). The transversal dimension of (32) is complementary to the transversal dimension of (27) (See FIG. 1). At the end of the width of (27), the wall (32) is monolithically continued by a partition or wall (33) extending vertically downwards seating against the external surface (12*c*, 12*d*) of both first and second shapes (10, 20) covering the union or joint between them. The inner edge of said upper surface (32) of each third shape has a longitudinal fold (34) monolithic and complementary to the longitudinal recess (27') of the respective second shape (21*a*, 21*b*) conveniently ending this fold (34) in a small vertical tab (35). The conformation of the longitudinal fold (34) is complementary to the conformation of the longitudinal recess (27') of the respective second shape (21*a*, 21*b*), this recess having a quadrangular section, so that in a complementary manner fold (34) presents a complementary step shape, seating in retention. (34) inside (27').

The lower end of partition (33) of each third shape (31*a*, 31*b*) has a fold (36) monolithically projected outwardly at the end of which it bends downwards in (38) without reaching the upper face of the corresponding wing (16*a*, 16*b*) of the first shape (10) forming at the lower end of (38) a longitudinal "L" seat (36') turned towards the external face (12*c*, 12*d*) of each column (12*a*, 12*b*) of the first shape (10).

Preferably, as illustrated in the figures, each third shape (31*a*, 31*b*) has its longitudinal upper surface (32) continued at (32') whose end is monolithically folded into a longitudinal external wall (37) extending downwards until reaching the lower height of the longitudinal seat in "L" (36').

Internally and at a certain height, partition (33) and the said external wall (37) are internally monolithically joined by a longitudinal partition (36"), substantially horizontal which internally defines between both walls (38, 37) a longitudinal housing (39*h*) within which it is possible to house a lighting device, such as for example, an LEDS tape, or a lighting device (not shown) that is protected, if desired, by a translucent cover (8) that sits on longitudinal opposing tabs (39).

Figure 7:
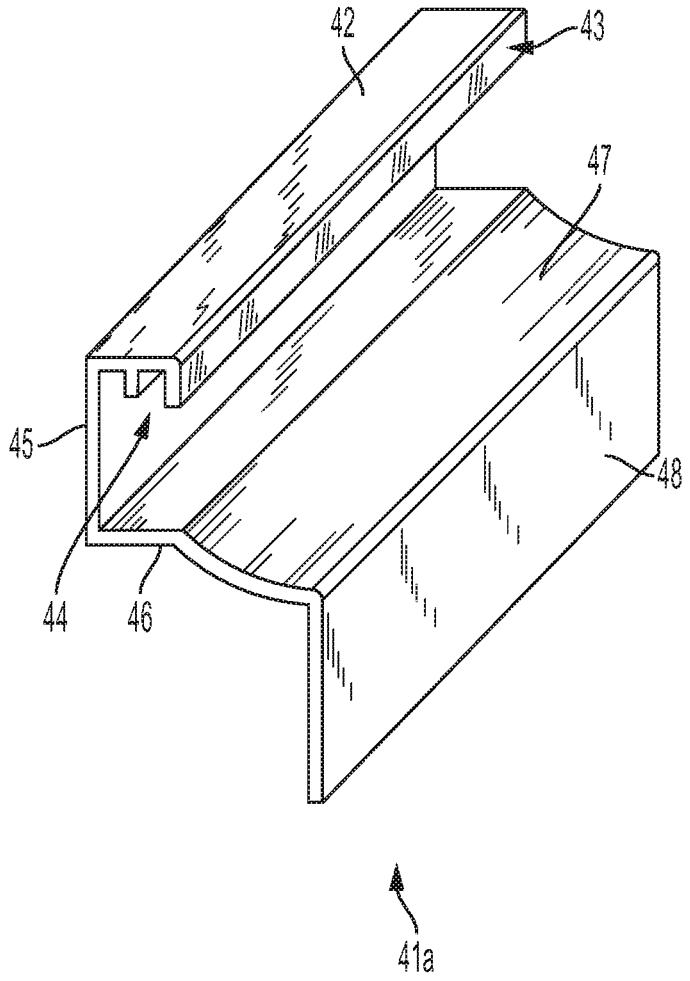
FIG. 7 illustrates a front/perspective of the fourth right side shape.
Figure 8:
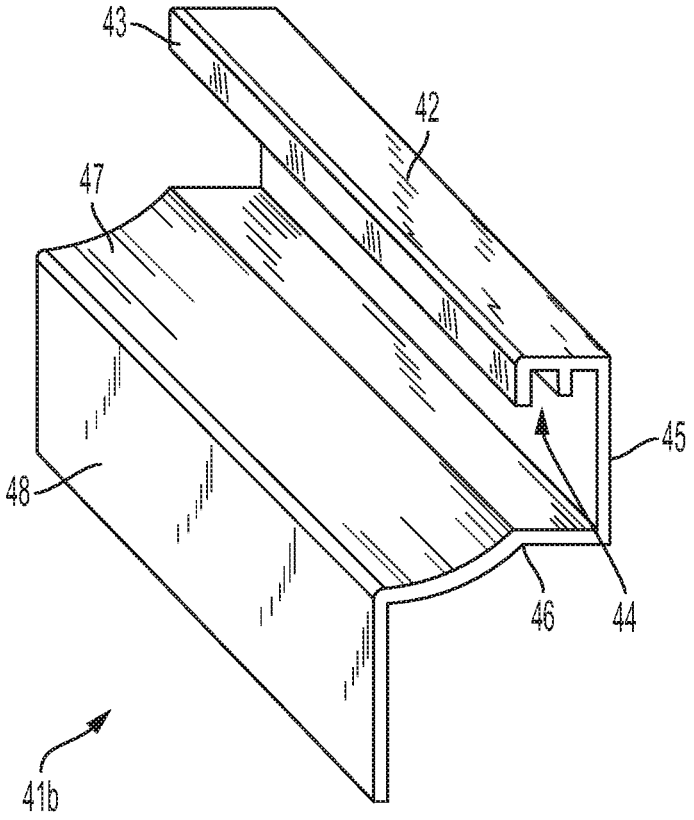
FIG. 8 illustrates a front/perspective of the fourth left side shape.

FIG. 7 illustrates isolated and in front/lateral perspective the second right hand shape (41*a*) and FIG. 8 shows the same shape in its specular version, that is, the fourth left hand shape (41*b*). Both shapes are identical in their geometry and height, with the exception that the right is the specular vision of the left and vice versa.

Each of said fourth shapes is placed on each side of the corresponding column of the first shape and has a substantially horizontal wing (42) which free end has a longitudinal projection (43) projecting downwards a short vertical section defining a longitudinal seat (44). The wing (42) on its internal edge has a section of shape (45) defining a vertical wall partially abutting against the external face (12*c*, 12*d*) of the respective column of (10) and projects downwards leaving a section of wall (12*c*, 12*d*) free without contact with said wall (45), at a distance from the respective wing (16*a*, 16*b*) of the first shape. A substantially horizontal longitudinal surface (46) is projected from the lower edge of (45), which can also be slightly oblique, and projects outwards until it is vertically aligned with (43).

Following the free edge of (46) the shape preferably has a curved longitudinal surface (47) with its concavity directed upwards, substantially facing the respective longitudinal housing (39*h*) of the corresponding third shape within which it is possible to accommodate the mentioned lighting device, and from the free edge of (47), the shape is completed monolithically with a vertical wall (48) that is attached in contact with the edge to the corresponding wing (16*a*, 16) of the first shape (10).

Figure 9:
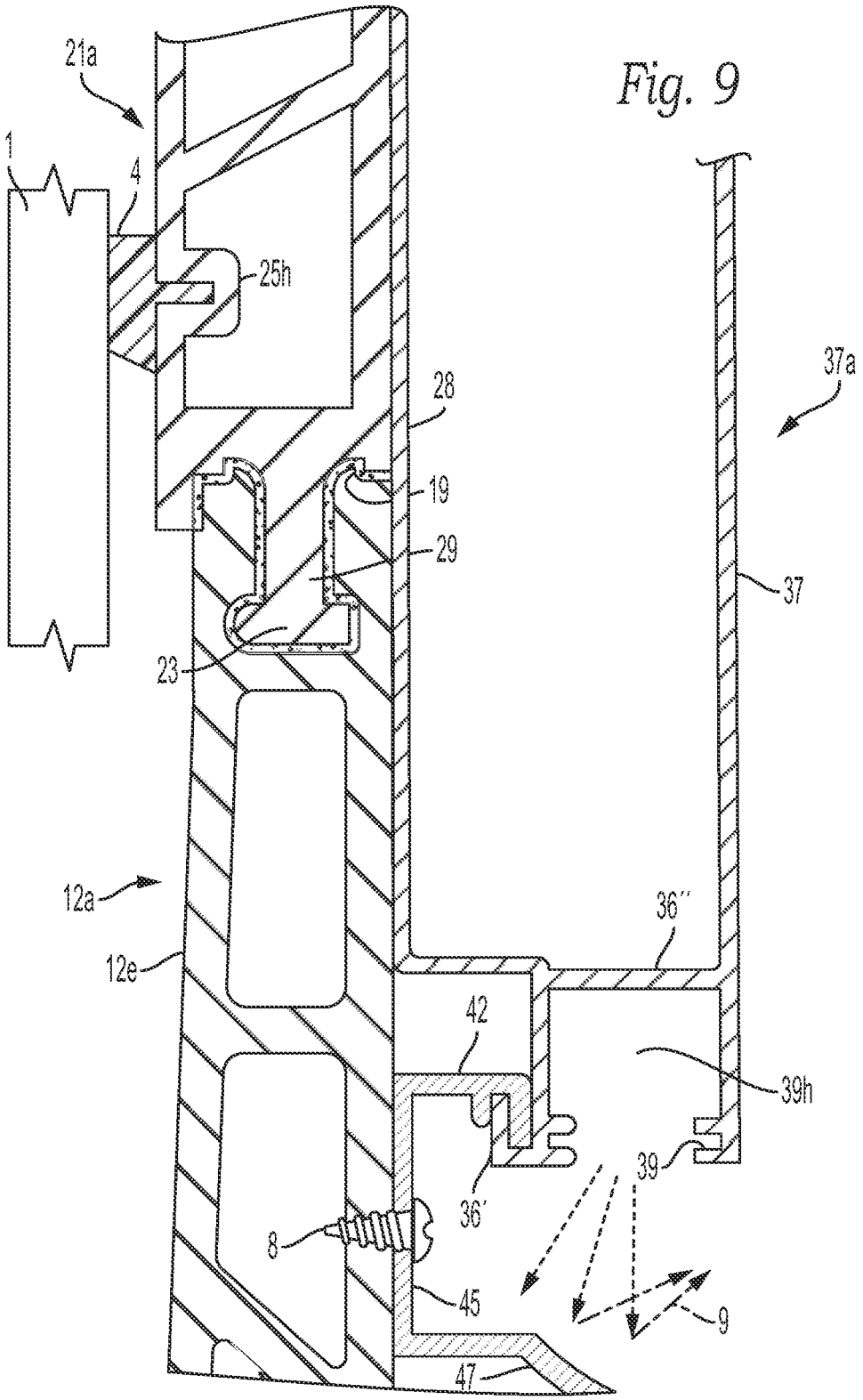
FIG. 9 is a partial enlarged detail of the assembly of part of the shapes.

FIG. 9 illustrates an enlarged and partial detail of the assembly between the four shapes. In said figure it is indicated with reference (9) the light beams coming from the source housed in (39*h*), and as the continuous concave surface (47) facing (39*h*) acts reflecting the light, it grants an unprecedented ornamental result for all shapes for these same purposes known in the art. With reference (8) one of the possible ways of linking the fourth shape to the first shape is indicated by immobilizing the set of shapes.

The unprecedented result achieved with the present invention is that it allows the creation of rails, enclosures or glass partitions up to a height of 3 meters, with these shapes having the ability to accommodate inside the channel (13) the end of the glass plate, said channel having a height that can reach up to approximately 17 cm. depending on the total height of the glass plate, which allows the glass plate to be housed and retained by embedding the glass plate vertically or slightly obliquely with respect to the vertical, depending on the slope of the cavity given by said channel, without the use of any auxiliary column, crosspiece or any other support structure or upright for the glass plate, thus achieving an unprecedented aesthetic effect by having the glass only held inferiorly presenting a panoramic view without obstructions.

As already explained, the use of the light source adds the ornamental aspect and indirect lighting unprecedented in the prior art.

Each of the said components comprising the set of shapes of the present invention, preferably, although this is not a limitation to the invention, are extruded shapes in aluminium and monolithic, which implies that each of its components, for example, walls, partitions, grooves, housings etc., extend longitudinally maintaining a same constant and equal cross section along the entire shape.

What I claim:

1. A set of extruded shapes for glass balcony railings and enclosures, each one of said set of extruded shapes comprising a longitudinal axis with equal transversal successive sections thereof perpendicular to said longitudinal axis, comprising in combination:

a first shape configured to be anchored to a surface, and comprising a base plate resting on said surface, monolithically projecting from said base plate two columns separated the one from the other defining in between its internal faces a longitudinal channel or space opened upwards, comprising an upper end of each of said columns with a longitudinal groove determining a wing on each side of each groove;

second shapes substantially placed vertically aligned on top of each of said columns of the first shape; an appendix projecting from a lower end of each of said second shapes and lodged in retention in the longitudinal groove of each column of the first shape, the mutually facing surfaces of said second shapes separated from each other in continuation of the longitudinal channel of the first shape; an upper end of each second shape having a longitudinal recess on its edge with an internal face thereof determining a seat and fastening means for a respective third shape: an external surface of each second shape is aligned in continuity to the external surface of each column of the first shape;

third shapes, each comprising at least one upper surface which rests on an upper end of the corresponding second shape, an internal edge of said upper surface of each third shape comprising a longitudinal fold complementary to the longitudinal recess of the second shape within which sits on retention; from an upper surface of each third shape a wall extends monolithically downwards adjacent to the external surface of both first and second shapes, covering the joint between them; a lower end of said wall of the third shape has a monolithically projected outward fold at the end of which bends downwards without reaching the upper face of the corresponding wing of the first shape, forming at the lower end a longitudinal "L" seat turned towards the external surface of each column of the first shape; and a wall from a fourth shape is placed against each side of the corresponding column of the first shape, a substantially horizontal wing projects from the upper end of said wall with a free end thereof comprising a longitudinal projection that seats in connection with the longitudinal "L" seat of the third shape, wherein the lower end of said wall of this fourth shape extends downwards until reaching a distance from the wing of the first shape, from which a longitudinal surface projects outward, ending abutting the edge of the respective wing of the first shape; each of said fourth shapes comprising retaining means to the external surface of each respective column of the first shape; the longitudinal channel between both columns of the first shapes and the internal faces of the second shapes determining a seat within which a glass plate lodges against polymeric wedges and counter-glass placed between said glass plate and the internal faces of the said longitudinal channel.

2. The set of extruded shapes of claim 1, wherein the longitudinal grooves at the top of each column of the first shape presents a first vertical section open upwards, followed by a dovetail-like expansion which houses in retention the appendix projecting downwards from the lower end of the second shape.

3. The set of extruded shapes of claim 1, wherein each upper portion of an external and an internal wall of each column of the first shape in its crown has a protruding longitudinal rib that sits in a complementary groove made in the lower end of the second shape that sits on said crown of each column of the first shape.

4. The set of extruded shapes of claim 1, wherein said upper surface of each third shape sits on the upper end of the second shape, continued by a substantially coplanar section of upper surface with a free end bending monolithically into a longitudinal external wall which is directed downwards; said external wall and a partition attached to the external surfaces of the first and second shapes inside it are monolithically joined by a substantially horizontal longitudinal partition which internally defines between both walls a longitudinal housing within which is placed a light source.

5. The set of extruded shapes of claim 1, wherein the fourth shape, between the substantially horizontal longitudinal surface and a vertical wall, has a curved longitudinal portion, with its concavity directed upwards substantially facing the respective longitudinal housing with the light source, said continuous concave surface defining a light reflecting means of the light emitted by said light source.

6. The set of extruded shapes of claim 1, wherein the glass plate housed in the channel seats with its lower edge on a polymeric wedge in "L" which laterally offers support to one face of the glass plate, while the opposite face of said glass plate is struck by another chock until its immobilization.

* * * * *